United States Patent [19]

Johnson

[11] Patent Number: 4,813,030

[45] Date of Patent: Mar. 14, 1989

[54] RESETTABLE MULTIPLE TIMER

[75] Inventor: Oliver F. Johnson, Arcata, Calif.

[73] Assignee: Kurt Jensen, Sacramento, Calif.

[21] Appl. No.: 76,899

[22] Filed: Jul. 23, 1987

[51] Int. Cl.[4] ..... G04F 1/04

[52] U.S. Cl. ..... 368/93

[58] Field of Search ..... 368/93–95

[56] References Cited

U.S. PATENT DOCUMENTS

| | | | |
|---|---|---|---|
| 2,144,857 | 1/1939 | Schultz | 368/93 |
| 2,199,645 | 5/1940 | McGehee | 368/93 |
| 2,540,502 | 2/1951 | Aschbacher | 368/93 |
| 2,948,404 | 8/1960 | Harrod | 368/95 |
| 3,103,099 | 9/1963 | Hanks | 368/93 |
| 3,125,849 | 3/1964 | Wachtel | 368/93 |
| 3,438,197 | 4/1969 | Roer | 368/93 |
| 3,505,873 | 4/1970 | Cornelison et al. | 368/93 |
| 4,340,947 | 7/1982 | Barton | 368/93 |
| 4,408,894 | 10/1983 | Hemperly | 368/93 |
| 4,431,313 | 2/1984 | Hemperly | 368/93 |
| 4,527,905 | 7/1985 | Kohls | 368/93 |

FOREIGN PATENT DOCUMENTS

| | | | |
|---|---|---|---|
| 373432 | 8/1922 | Fed. Rep. of Germany | 368/93 |
| 1209522 | 3/1960 | France | 368/93 |

*Primary Examiner*—Bernard Roskoski

[57] ABSTRACT

A timing device of the flowing medium type that allows for multiple timing periods and for instant resetting capabilities whether the timer is in a timing sequence or is at rest. The timer is so constructed that specified 90° or 180° revolutions of the unit instantly combine all the timing medium, divide the timing medium by causing it to fall onto dividing baffles and then into separate reservoirs, activate the selected timing mode, or interrupt the timing process. The timing sequence of the timer may be interrupted at any time and be immediately reset to begin the same sequence again or to start a sequence of a different time duration by making the proper revolution of the timing device.

7 Claims, 1 Drawing Sheet

RESETTABLE MULTIPLE TIMER

BACKGROUND OF THE INVENTION

Timers using sand, liquid, or other flowing media are well known in the prior art, and are exemplified in the patent of Ira E. McGehee, U.S. Pat. No. 2,199,645, and the centuries-old sand hourglasses.

The McGehee U.S. Pat. No. 2,199,645 discloses a flowing medium timing device that provides for one particular timing interval and the capability of resetting that interval whether or not the timing medium has completed its passage through the restricting orifice. This resetting feature teaches that the timing medium may be totally collected at any point in the timing sequence by revolving the timer 360° so that all the timing medium merges and is made instantly available for another timing sequence. Thus the timer is designed for instant resettability for a one time-interval determined by the total amount of the timing medium encased therein.

Further, it has been taught by Hemperly, U.S. Pat. No. 4,408,894 that single, partial portions of timing medium may be loaded or removed for a pre-determined timing interval by rotating the timing device 360° for each portion to be added to or subtracted from the total quantity of timing medium to be used for a specified timing interval.

It is desireable that a flowing-medium timing device be made available that can be used to measure more than one time interval and also be instantly resettable to each and every one of those timing modes whether or not the previous timing interval has been completed.

SUMMARY OF THE INVENTION

It is therefore the object of this invention to provide an improved flowing-medium timing device that simultaneously provides different timing modes, each or any of which may be instantly set or reset at the user's discretion, and each or any of which may be interrupted instantly at any time during a timing interval to be readied for a new or repeat timing mode or interval.

BRIEF DESCRIPTION OF THE DRAWINGS

The instant setting and resetting capabilities of the present invention, in addition to the different timing mode allowances, will be made evident from the following detailed description and figures, of which.

DETAILED DESCRIPTION OF THE INVENTION

Figure 1:
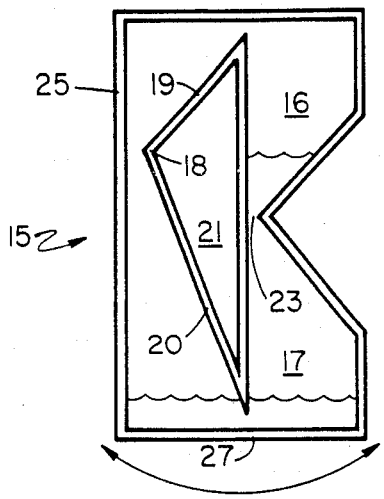
FIG. 1 is a side elevation view of the preferred embodiment of the invention.
Figure 2:
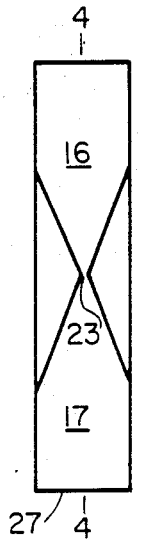
FIG. 2 is a front elevation view of the preferred embodiment of the invention.
Figure 3:
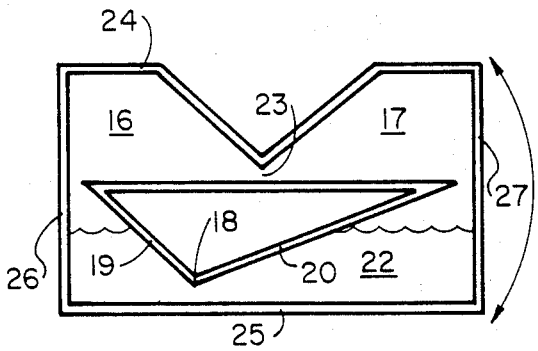
FIG. 3 is a side elevation view illustrating the collection of all timing medium prior to activating the timer for a particular timing mode.
Figure 4:
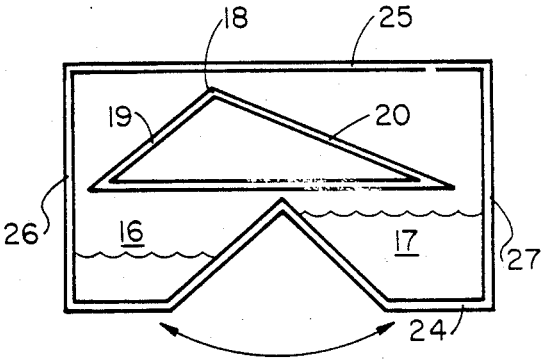
FIG. 4 is a side elevation view showing the division of the timing medium into two inequal portions, either of which may be put into play with a 90° turn of the timing device.
Figure 5:
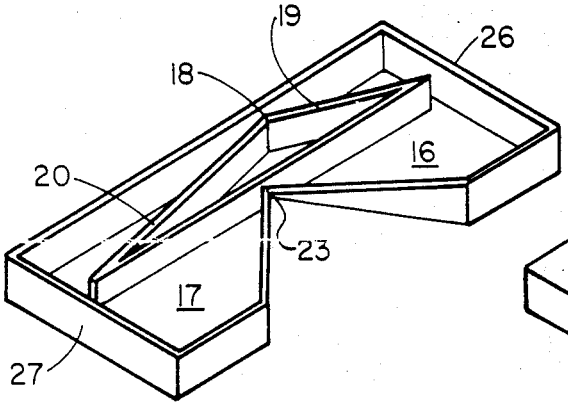
FIG. 5 is a perspective view of the case as divided at lines 4—4 showing the baffles, restricting orifice, and reservoirs.
Figure 6:
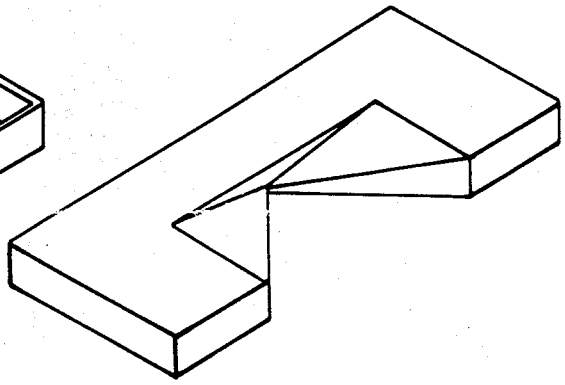
FIG. 6 is a perspective view of the portion of the case which would be welded, glued, or otherwise attached to FIG. 5 in order to create an integral and sealed unit.

FIG. 1 is a side elevation view of the preferred embodiment of the timing device 15 which includes baffles 19 and 20, a restricted flow timing orifice 23 and interior reservoir areas 16, 17 and 22 in which the timing medium may collect or be collected prior to, during, or after the timing action. Reservoir area 21 is void.

During one of the timing intervals, the timing medium will evacuate by gravity flow from the upper reservoir 16 through the restricting orifice 23 to the lower reservoir 17 as shown in FIG. 1 if the timer will be placed on end 27.

In another timing mode the timing device would be upended and the timing medium will evacuate reservoir 17 through the restricting orifice 23 to reservoir 16 if the timer will be placed on end 26.

To prepare for the activating of the timing device, the unit is placed on its back 25 and all of the timing medium is collected by gravity flow to chamber 22.

Since baffles 19 and 20 are of different lengths and are connected at apex 18, the timing medium will be divided accordingly when the timer is revolved from the position on its back 25 to that of the position on its front 24. The greater amount of the timing medium will fall onto baffle 20 and further fall to reservoir 17; the smaller amount of the timing medium will fall on baffle 19 and further fall to reservoir 16.

The timing device may be positioned on its front 24 for inactive placement until a timing interval is desired and activated.

When the timing device is to be activated, it is tilted 90° to its end 26 in order to allow the larger quantity of timing medium to begin flowing through the timing orifice 23; alternately, it may be tilted 90° to its end 27 in order to allow the smaller quantity of timing medium to begin flowing through the timing orifice 23.

At any time during, or at the cessation of, either of the timing activities the timing device may be replaced on its back 25 and all timing medium will be once again immediately collected and made ready for instant resetting to either of the different time interval positions by rotating the timing device 90° in the appropriate direction.

What is claimed is:

1. A resettable multiple timing device, comprising:

a transparent housing, said housing adapted to be sealed so as to provide a closed system;

a quantity of timing medium;

a pair of baffles, adapted to divide said timing medium into unequal measured portions when said timing device is properly rotated;

a restricted flow timing orifice, said orifice adapted to meter the flow of said timing medium therethrough; and a plurality of reservoir areas, connected to said baffles, each of said reservoir areas adapted to allow at least a portion of said timing medium to be collected therein; and wherein substantially all of said quantity of medium may be brought together instantly in one of said reservoirs for future separative use, and wherein a 180° revolution of the timing device will cause said timing medium to be separated into first and second unequal quantities; and wherein said first quantity of timing medium flows into a first reservoir, and said second quantity of timing medium flows into a second reservoir, said first and second reservoirs being divided by said restricted flow orifice; and wherein said first and second quantities of the timing medium are adapted to provide a choice between first and second time intervals, respectively.

2. The resettable multiple timing device, as defined by claim 1, wherein said timing medium consists of a liquid.

3. The resettable multiple timing device, as defined by claim 1, wherein said first and second time intervals selectively activated by a 90° rotation of said timing device, dependent upon the direction in which said timing device is rotated.

4. The resettable multiple timing device, as defined by claim 1, wherein said timing medium coursing through said restricted flow orifice may be interrupted instantly by proper rotation of said timing device, so as to reset and ready said timing device for reuse.

5. A resettable multiple timing device, as defined by claim 1, wherein said timing medium consists of a granular substance.

6. A resettable multiple timing device, as defined by claim 1, wherein said baffles are of different lengths.

7. A resettable multiple timing device, as defined by claim 1, wherein an apex is formed by said baffles, so as to unequally distribute said timing medium on opposite sides thereof.

* * * * *